US010065099B2

(12) United States Patent
Dagn

(10) Patent No.: US 10,065,099 B2
(45) Date of Patent: Sep. 4, 2018

(54) TENNIS TRAINING APPARATUS

(71) Applicant: Josef Dagn, Kössen (AT)

(72) Inventor: Josef Dagn, Kössen (AT)

( * ) Notice: Subject to any disclaimer, the term of this patent is extended or adjusted under 35 U.S.C. 154(b) by 0 days.

(21) Appl. No.: 15/326,586

(22) PCT Filed: Jul. 7, 2015

(86) PCT No.: PCT/EP2015/065471
§ 371 (c)(1),
(2) Date: Jan. 16, 2017

(87) PCT Pub. No.: WO2016/008767
PCT Pub. Date: Jan. 21, 2016

(65) Prior Publication Data

US 2017/0203183 A1 Jul. 20, 2017

(30) Foreign Application Priority Data

Apr. 6, 2017 (DE) ..... 20 2014 103 293 U

(51) Int. Cl.

| | |
|---|---|
| ***A63B 69/38*** | (2006.01) |
| ***A63B 69/00*** | (2006.01) |
| ***A63B 43/00*** | (2006.01) |
| *A63B 71/02* | (2006.01) |
| *A63B 71/00* | (2006.01) |
| *A63B 71/06* | (2006.01) |

(52) U.S. Cl.

CPC ..... *A63B 69/38* (2013.01); *A63B 43/008* (2013.01); *A63B 69/0091* (2013.01); *A63B 71/023* (2013.01); *A63B 2071/0063* (2013.01); *A63B 2071/025* (2013.01); *A63B 2071/026* (2013.01); *A63B 2071/0694* (2013.01); *A63B 2209/00* (2013.01); *A63B 2209/08* (2013.01); *A63B 2220/53* (2013.01); *A63B 2225/093* (2013.01)

(58) Field of Classification Search

CPC ... A63B 69/38; A63B 69/0091; A63B 43/008; A63B 71/023; A63B 2071/025; A63B 2071/026; A63B 2071/0694; A63B 2209/00; A63B 2209/08; A63B 2220/53; A63B 2225/093; A63B 2071/063

See application file for complete search history.

(56) References Cited

U.S. PATENT DOCUMENTS

| | | | | | |
|---|---|---|---|---|---|
| 2,578,313 | A | * | 12/1951 | Moseley | A63B 69/0091 473/426 |
| 2,713,487 | A | * | 7/1955 | Jaediker | A63B 69/0091 473/145 |
| 3,731,926 | A | * | 5/1973 | Vincent | A01K 15/025 273/142 R |
| 3,876,203 | A | * | 4/1975 | Gold | A63B 69/0075 473/417 |
| 3,924,853 | A | * | 12/1975 | Schleeger | A63B 69/0091 473/429 |

(Continued)

*Primary Examiner* — Raleigh W Chu
(74) *Attorney, Agent, or Firm* — Horst M. Kasper, Esq

(57) ABSTRACT

The invention relates to a tennis training apparatus, comprising a support bar (5) joined in an articulated manner to a base (B, 6) and pivotable between a first (8) and a second stop (9) and which supports in a pivotable manner a profiled rod (3) protruding from the support bar (5), at the free end of the profiled rod (3) a ball (1) is rotatably supported, wherein the second stop (9) in direction of stroke is pivotably supported against a force.

15 Claims, 13 Drawing Sheets

(56) References Cited

Figure 1:
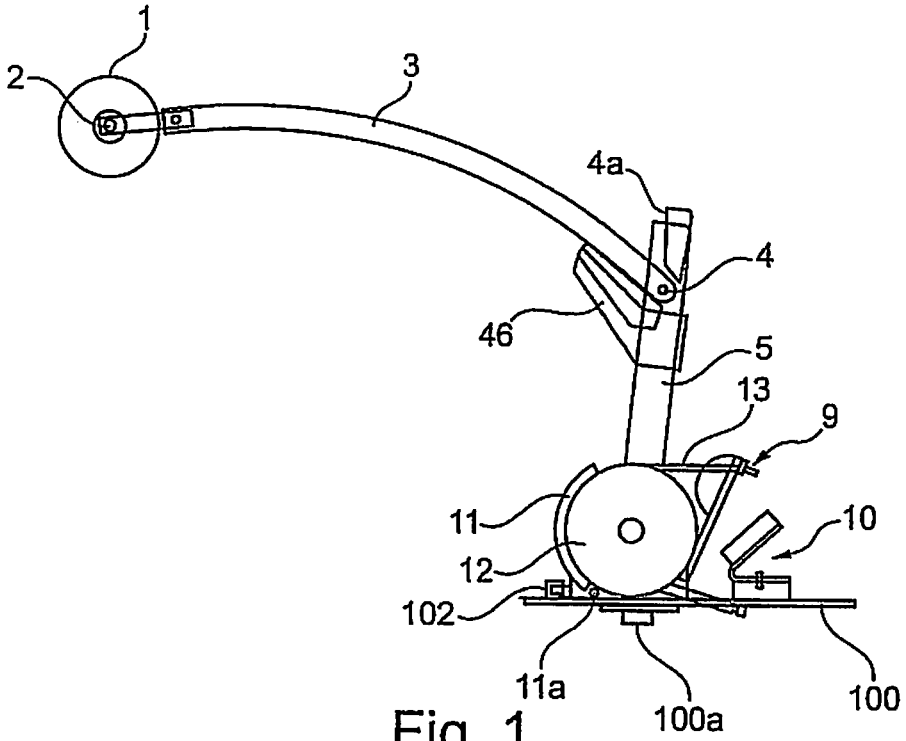

U.S. PATENT DOCUMENTS 4,089,521 A * 5/1978 Berst ..... A63B 69/0091 473/429
4,105,203 A * 8/1978 Cho ..... A63B 69/0091 473/429
4,204,678 A * 5/1980 Weis ..... A63B 69/0091 473/423
4,258,916 A * 3/1981 Beam ..... A63B 69/0091 473/429
4,531,734 A * 7/1985 Herrick ..... A63B 69/0091 473/429
4,679,790 A * 7/1987 Ham ..... A63B 69/0091 473/429
4,989,867 A * 2/1991 Herrick ..... A63B 69/0091 473/429
5,203,558 A * 4/1993 An ..... A63B 69/0091 473/423
5,393,050 A * 2/1995 Lloyd ..... A63B 69/0091 473/417
5,685,542 A * 11/1997 Weis ..... A63B 69/0091 473/459
6,458,037 B1 * 10/2002 Dixon, Jr. ..... A63B 69/0002 473/219
7,070,520 B1 * 7/2006 An ..... A63B 69/0091 473/139
9,149,707 B2 * 10/2015 Cochran ..... A63B 69/38
2002/0111233 A1 * 8/2002 Lloyd ..... A63B 69/0091 473/429
2006/0035729 A1 * 2/2006 Wang ..... A63B 69/0002 473/417
2007/0054756 A1 * 3/2007 Hanson ..... A63B 69/0091 473/451
2013/0196794 A1 * 8/2013 Wheelbarger ..... A63B 69/20 473/422
2017/0203183 A1 * 7/2017 Dagn ..... A63B 69/38

* cited by examiner

TENNIS TRAINING APPARATUS

The invention relates to a tennis training apparatus.

DE 20 2011 107 013 describes a tennis training apparatus which is especially embodied for practising slice and topspin strokes. A guide mechanism is provided, which is swivelable against elastic force and articulatedly hinged to a horizontally displaceable carriage, wherein a bracket mounted at the free end of the guide mechanism holds the ball in a rotatable manner and the carriage is displaceable against elastic force in a longitudinal guide.

The invention is based on the object of developing a tennis training apparatus of this type such that essentially all kinds of strokes including forehand and backhand strokes can be practised.

According to the invention, a ball is supported in a rotatable manner at the free end of a profiled rod, which is pivotable at a support bar which is pivotable between a first and second stop, wherein the second stop, lying in the direction of stroke, is yieldingly supported against the effect of a force.

The tennis training apparatus according to the invention comprises a support bar, which is articulately hinged at a base and pivotable between a first and second stop, wherein the support bar supports the profiled rod protruding from the support bar; a ball is supported at the free end of the profiled rod in a rotatable manner, wherein the second stop in stroke direction is pivotably supported against a force, for example against a spring force, so that a movement of the support bar abutting in the direction of stroke at the second stop is possible, which movement is decelerated by the opposing force.

For example, the second stop in the direction of stroke can be pivotably supported by a displaceable counterweight, which is moved, preferably pivoted, by a pivot movement of the second stop.

According to a further embodiment, the force acting at the second stop can be embodied by a rotatable counterweight, which is mounted on the circumference of a disc, which is connected by means of a rope to the stop.

Here, the effect of the force of the rotatable counterweight can be influenced by a curve on the disc along which the pulley extends.

According to a further advantageous embodiment, the support bar can be pivotably supported between two plates forming a bearing block. The bearing block is preferably mounted on a base plate, which is pivotable by means of a displacement means relative to a stationary structure around a vertical pivot axis and is fixable in the pivot position.

Advantageously, the base plate is pivotable on a pivotable plate in a small angle range, wherein magnets arranged at a distance from each other allow an oscillation of the bearing block between the magnets.

The profiled rod is preferably formed longer than the support bar and it is pivotable between stops at the support bar, so that the profiled rod already performs a movement in the direction of stroke after a stroke on the ball, before the support bar is pivoted.

In order that the profiled rod is not contacted by the tennis racket during the follow-through of the tennis racket, the profiled rod is preferably bent.

The pivotable support of the profiled rod at the support bar is preferably displaceable along the support bar, for example by means of a sleeve displaceable on the support bar, which sleeve can be fixedly connected in each position to the support bar.

The training apparatus can be arranged stationary. Preferably, the apparatus is arranged in a housing which is displaceable on a carriage in height by means of a rod assembly, wherein the carriage can be fixed or locked on the bottom.

Different sensors and an electronic storage unit can be provided, by which parameters of the ball movement are recorded and stored, so that the ball movement after a stroke with the tennis racket on the ball can be represented on a monitor.

Advantageously, the ball is supported in a rotatable manner at the free end of the profiled rod, with different colouring on the circumference, so that, by means of the different colouring of the ball, the direction of rotation after a stroke is optically easily recognisable.

Preferably the ball is formed by two half shells, which preferably consist of foamed material like, for example, polyurethane foam.

Figure 2:
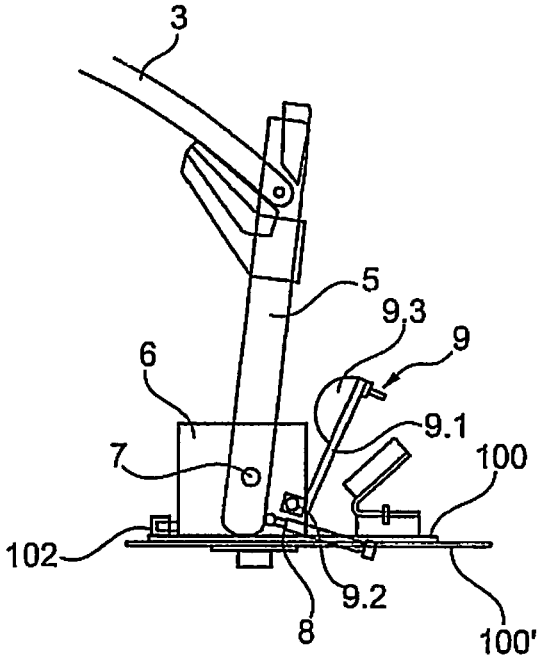
Figure 3:
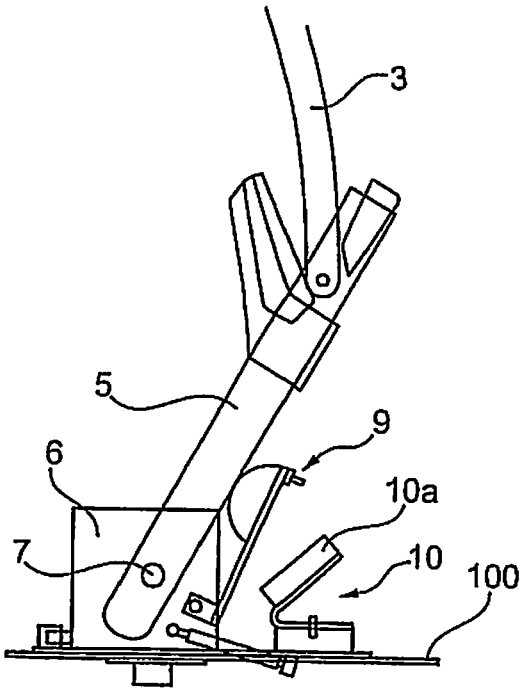
Figure 4:
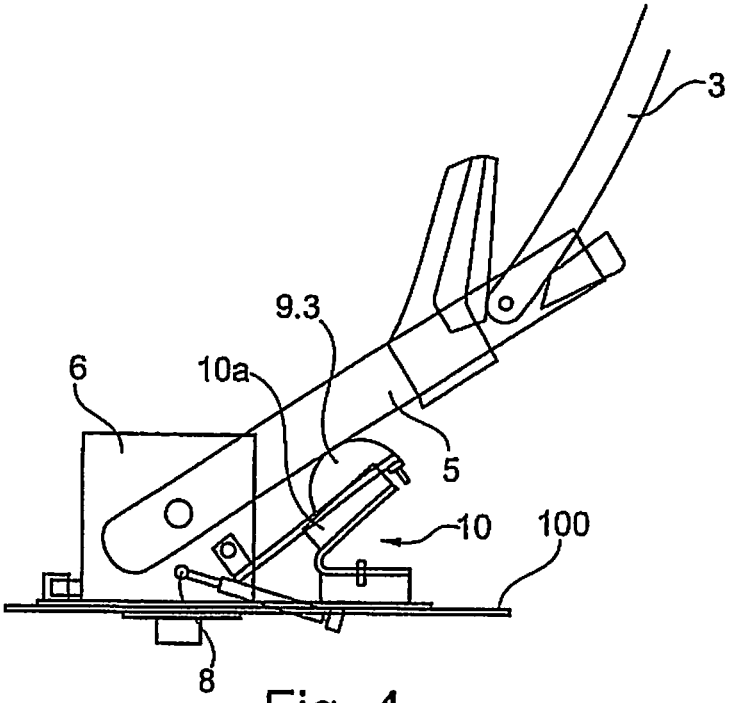
Figure 5:
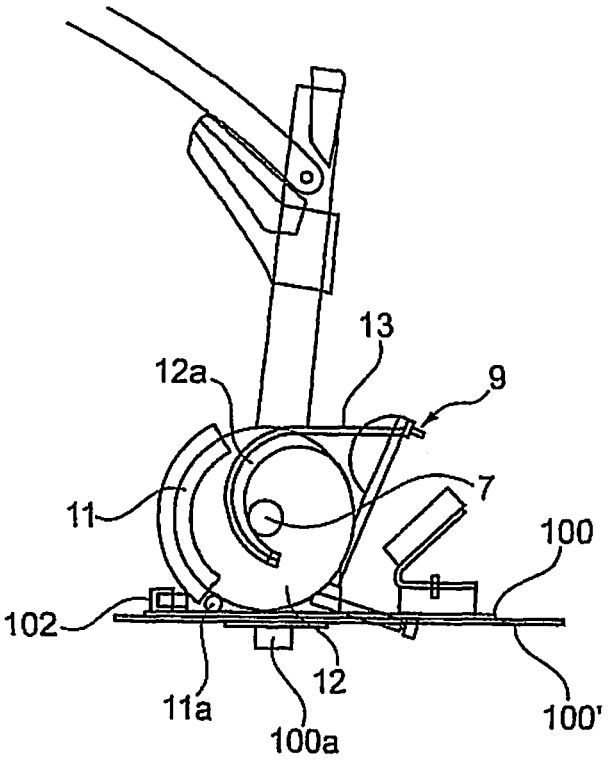
Figure 6:
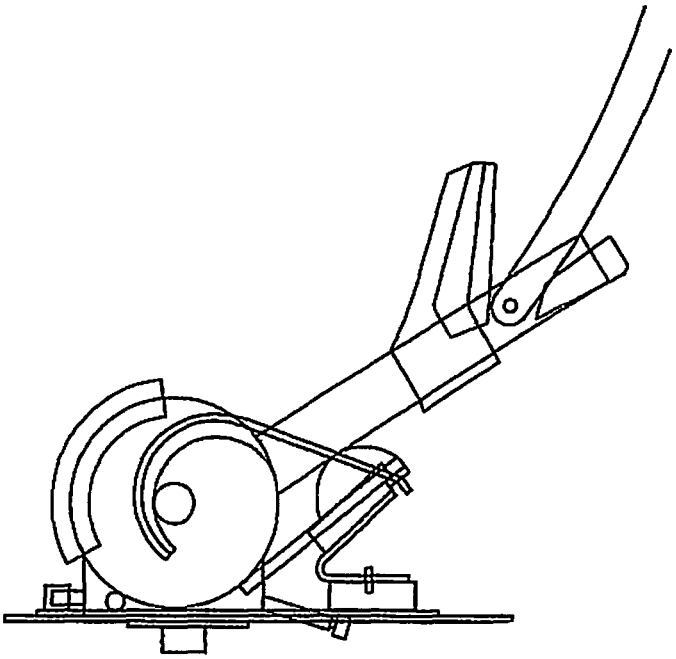
Figure 7A:
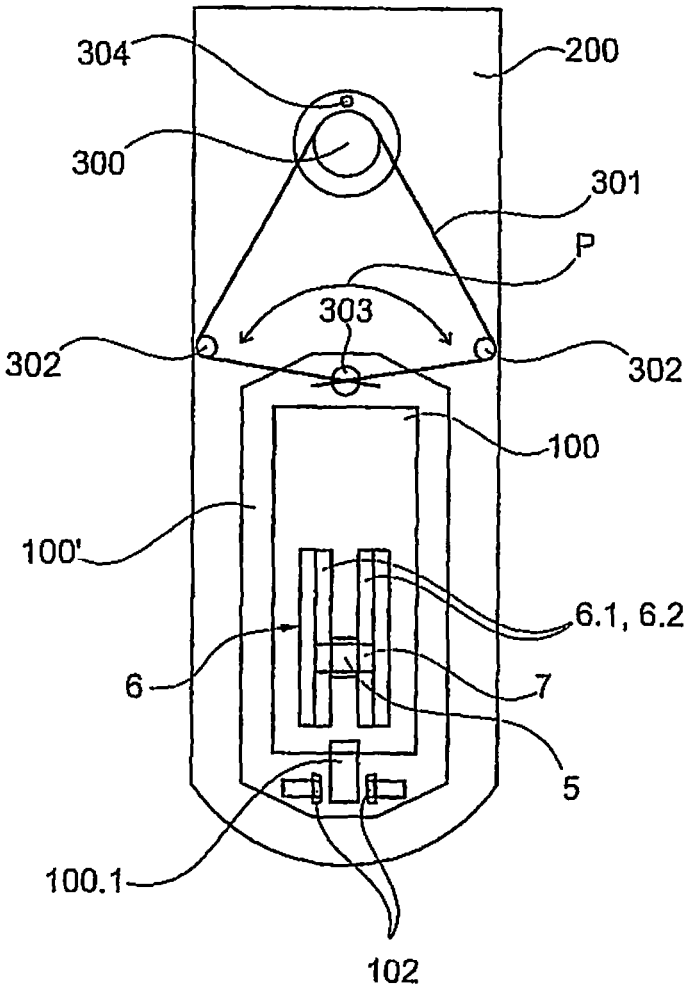
Figure 7B:
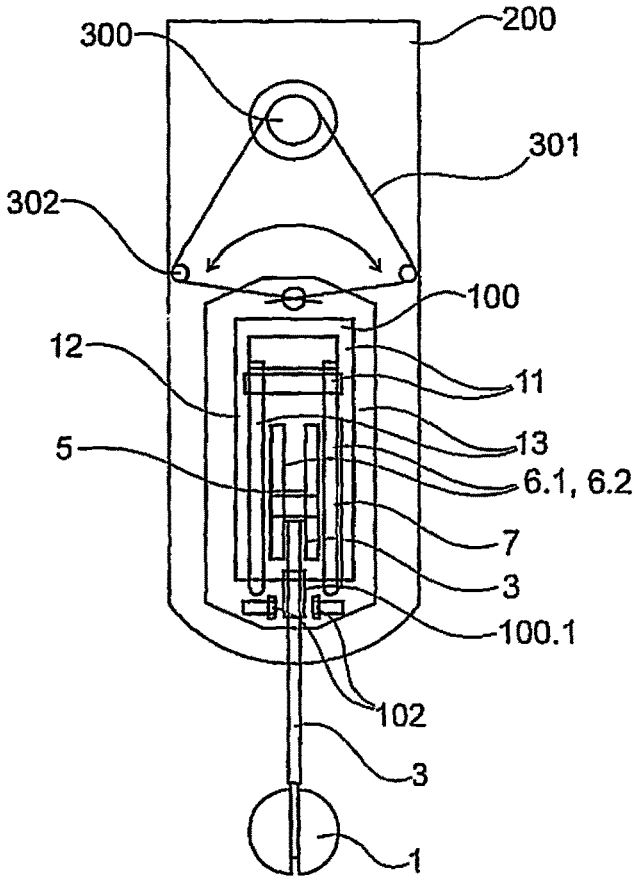
Figure 8:
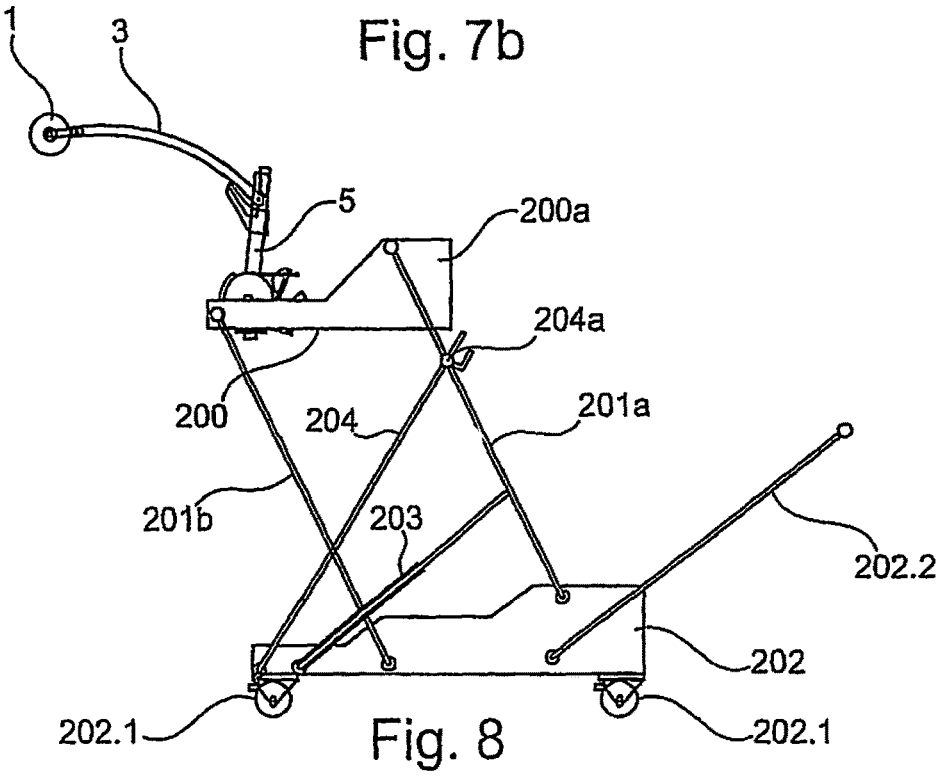
Figure 8A:
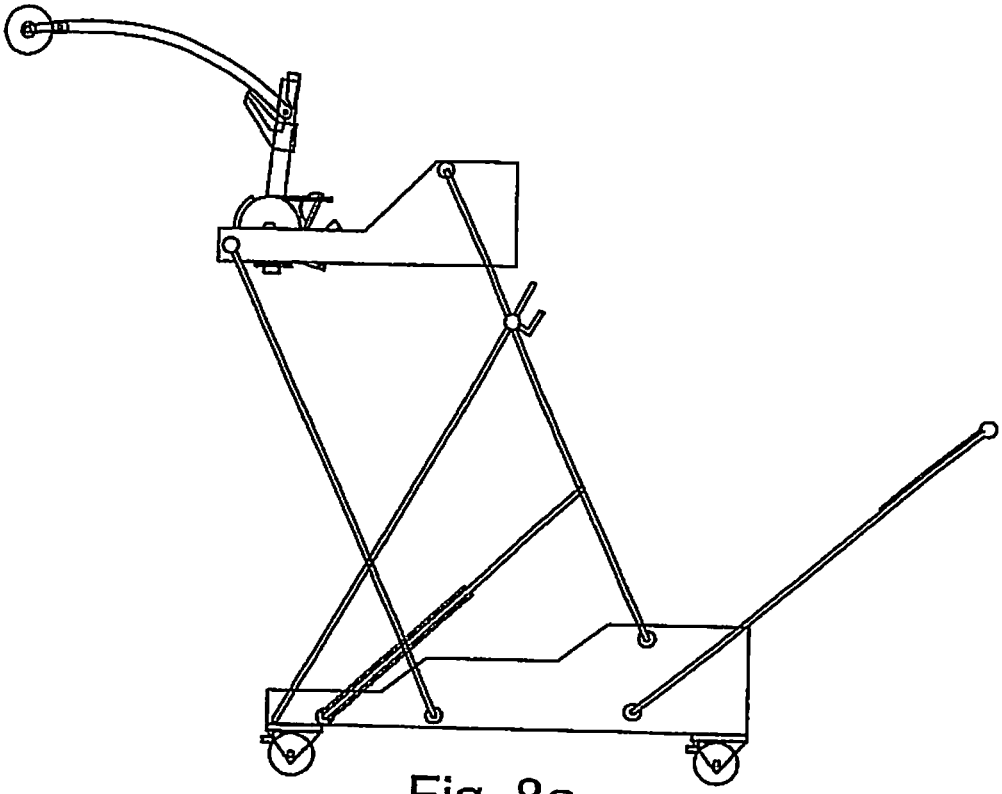
Figure 8B:
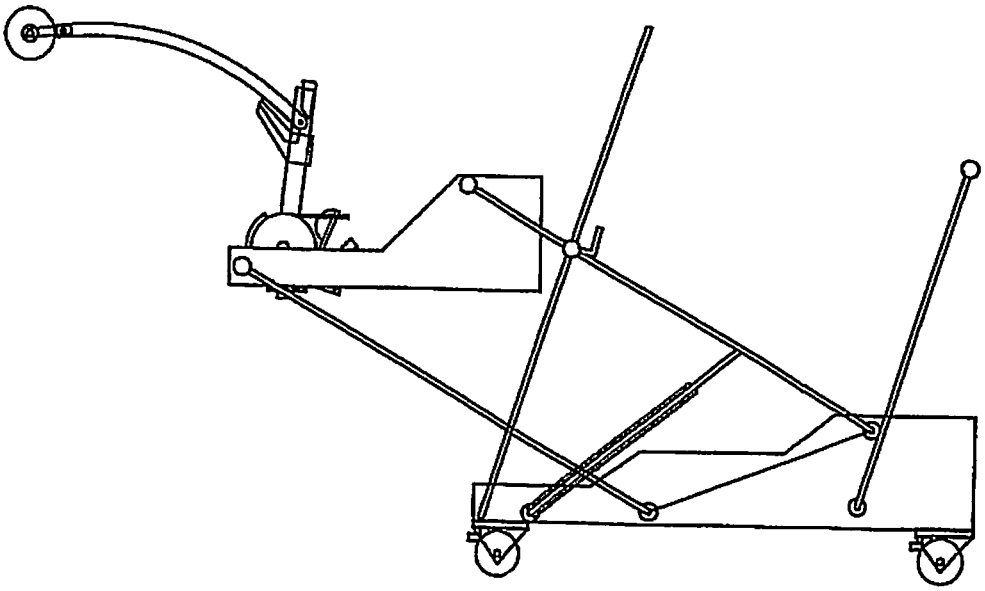
Figure 9A:
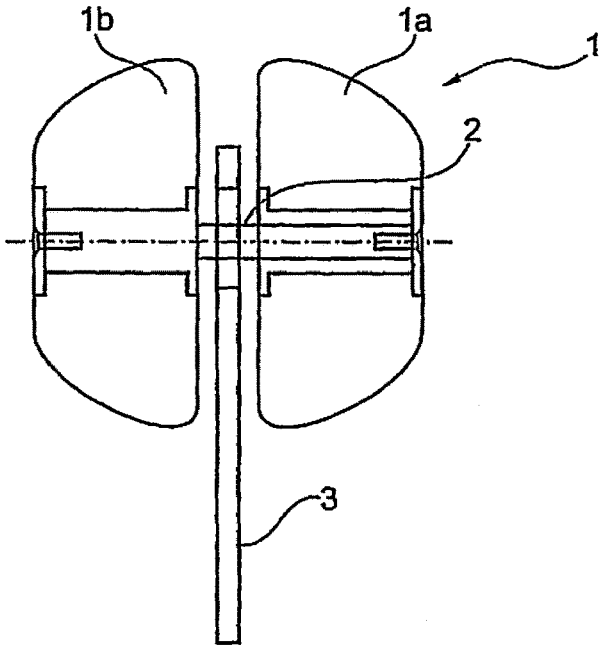
Figure 9B:
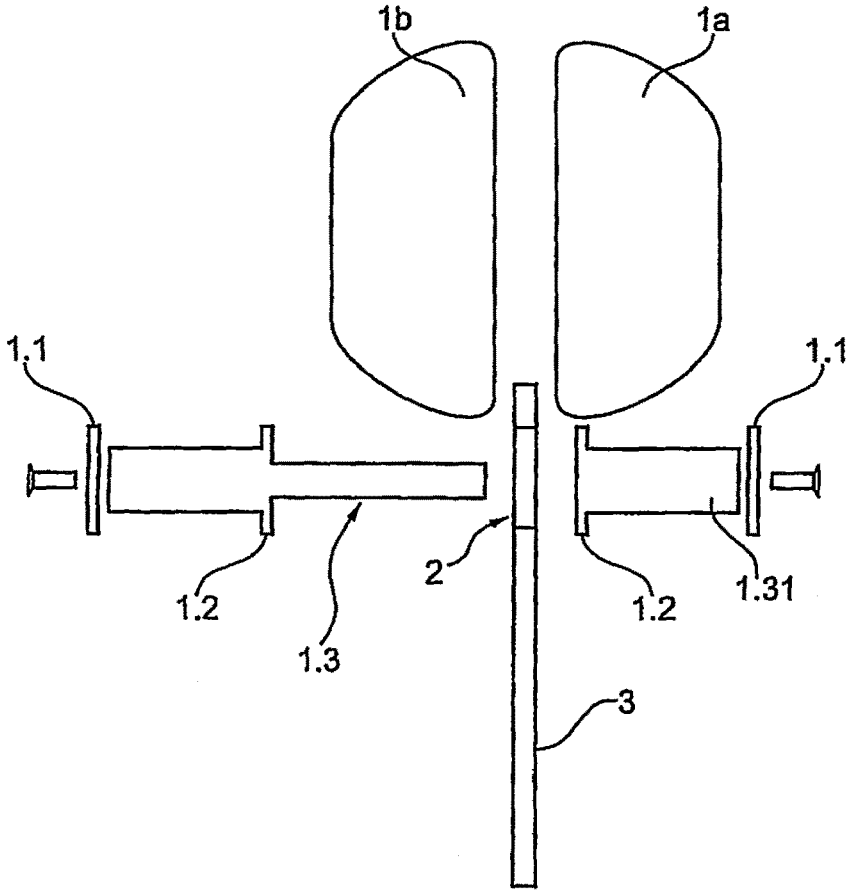
Figure 10:
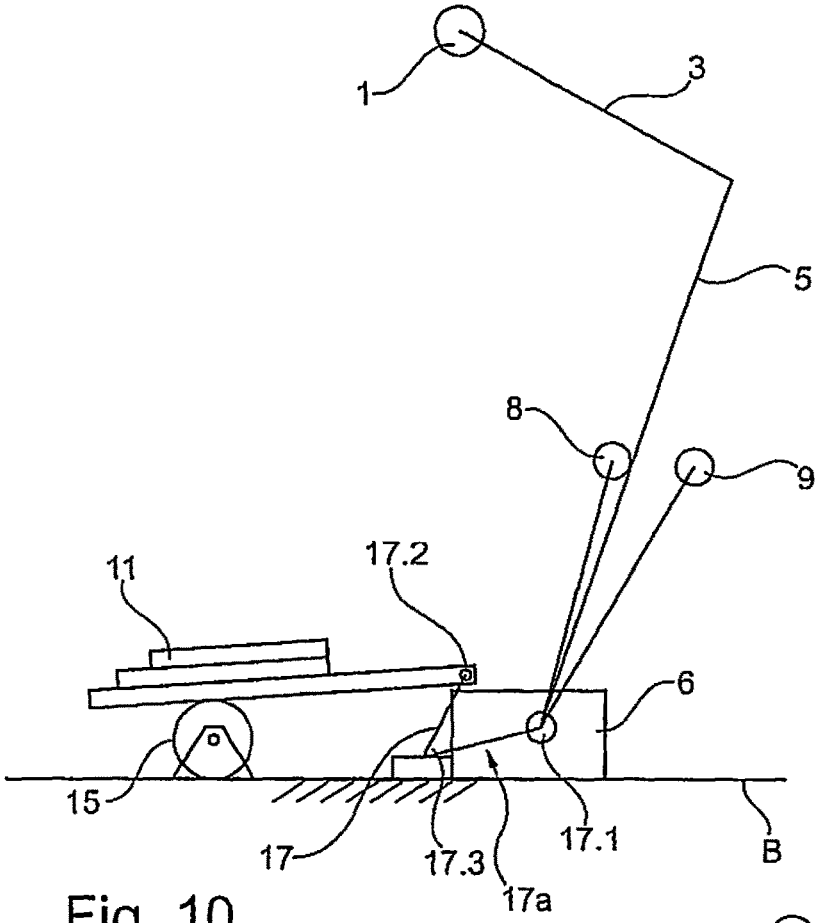
Figure 11:
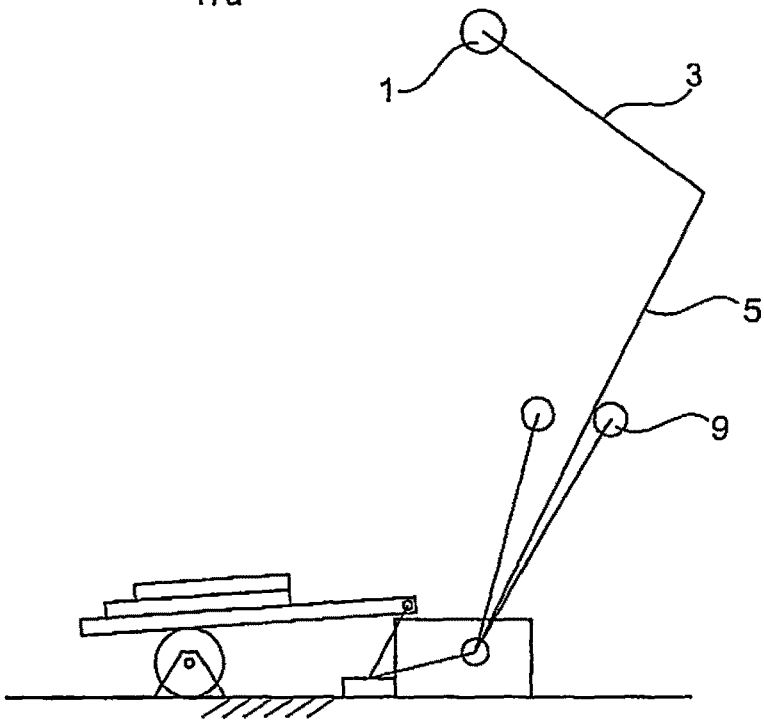
Figure 12:
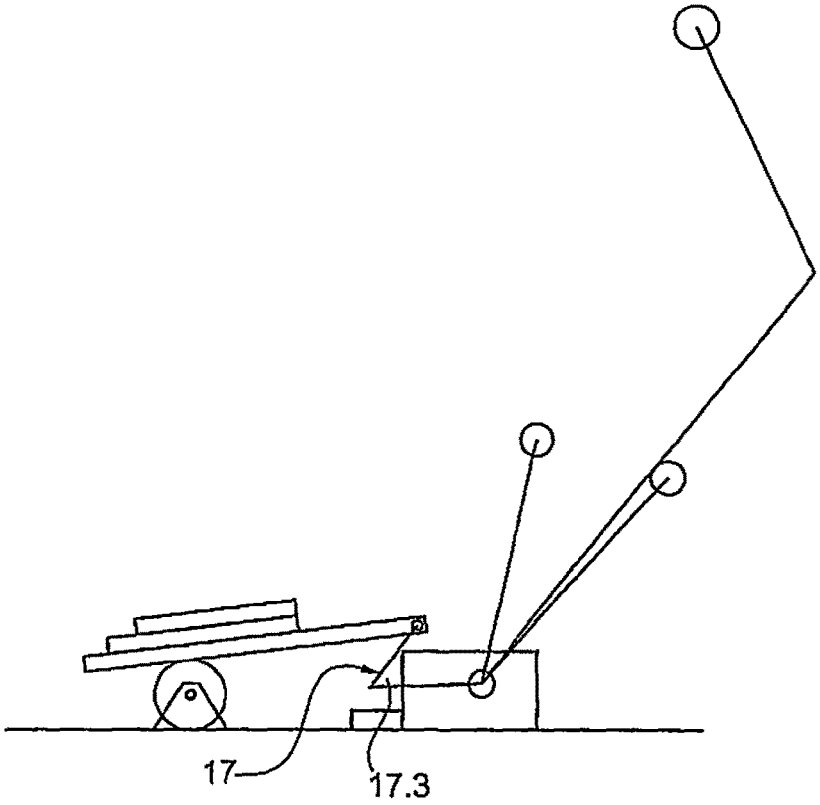
Figure 13:
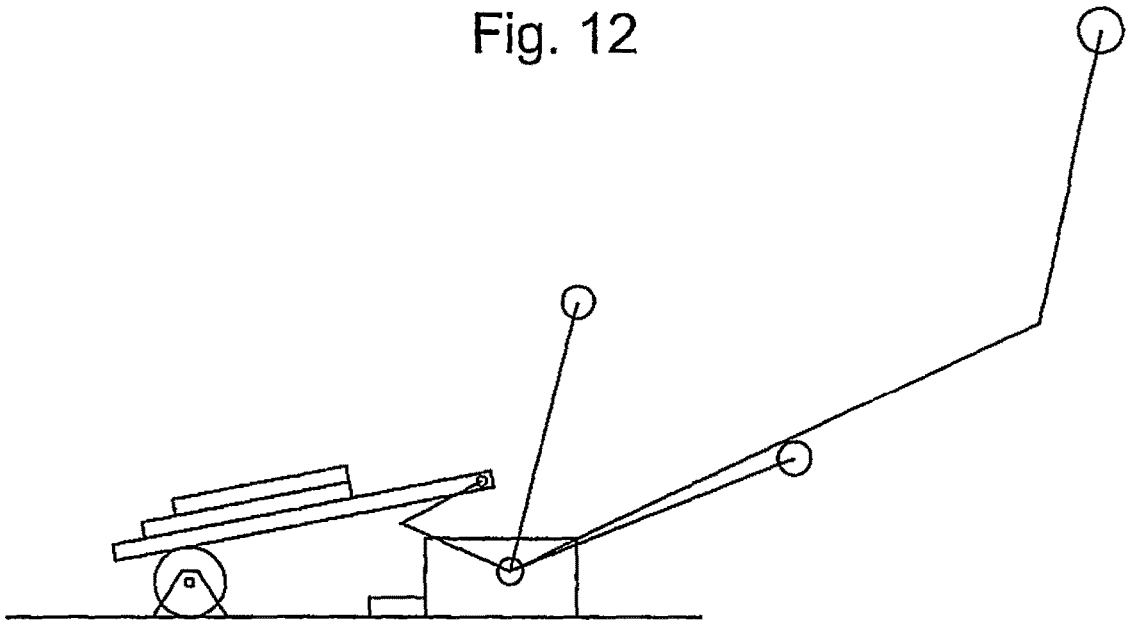
Figure 14:
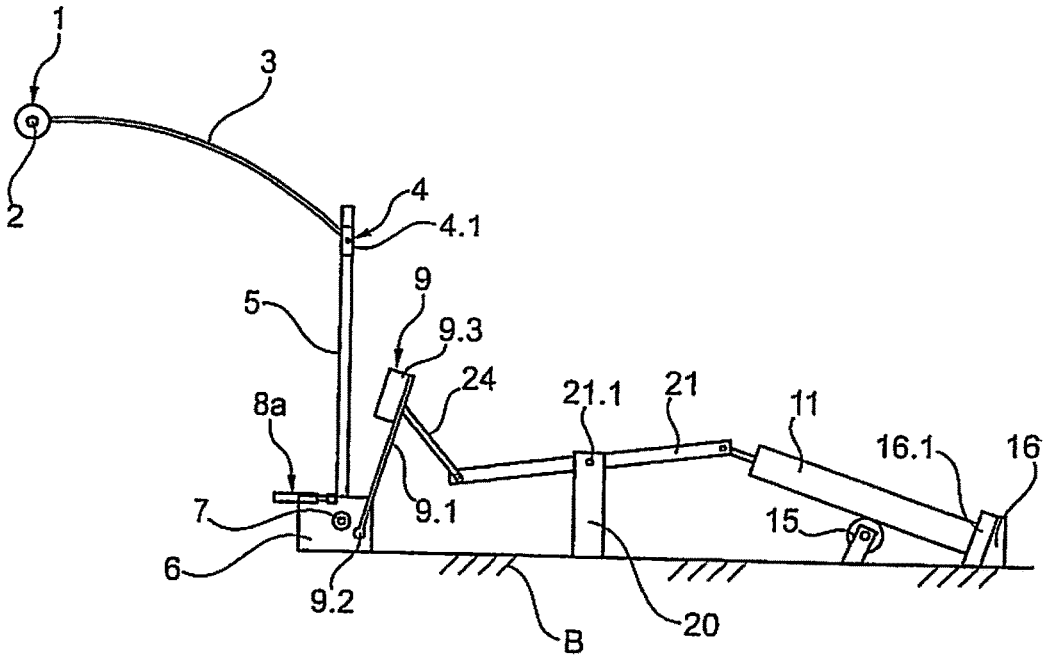
Figure 15:
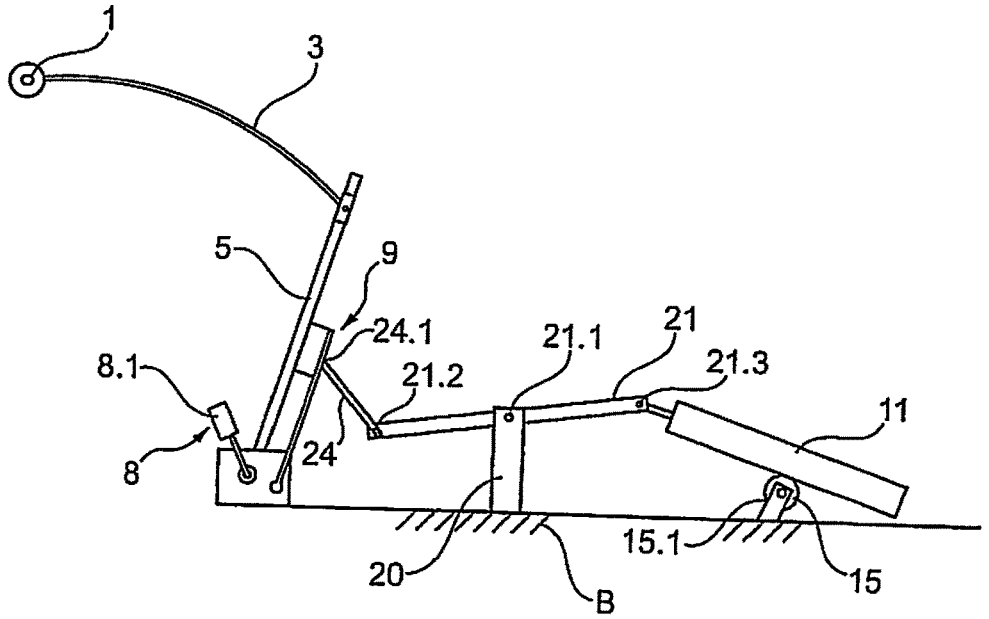
Figure 16:
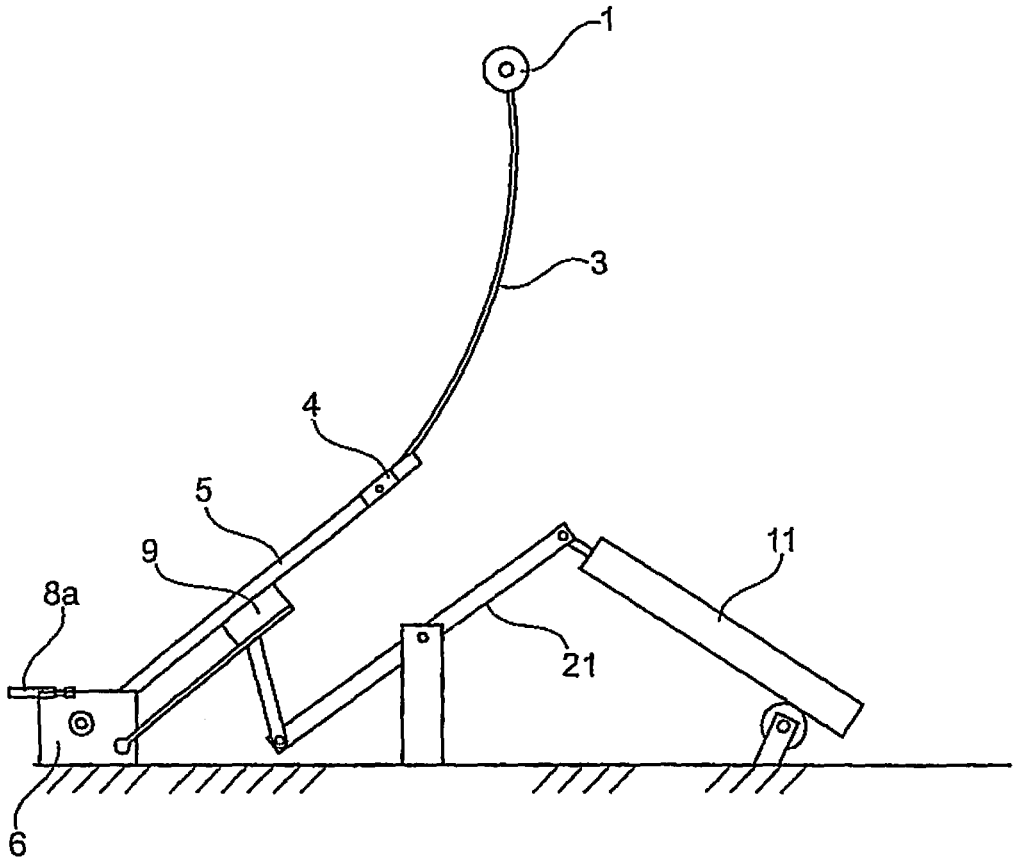
Figure 17:
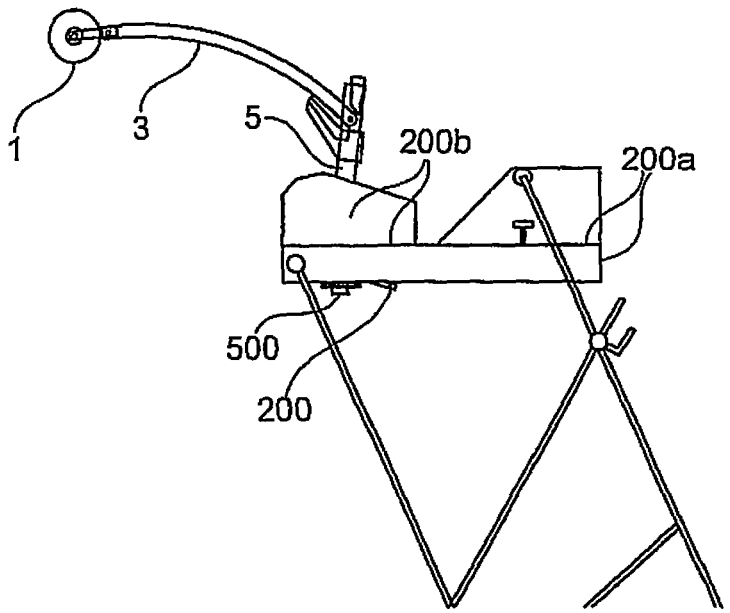
Figure 18:
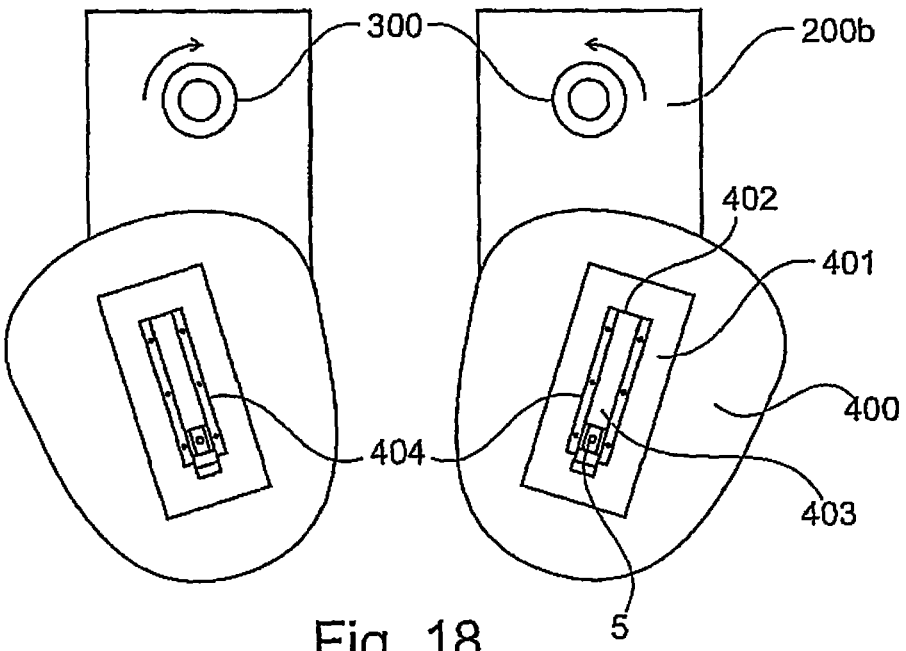
Figure 19:
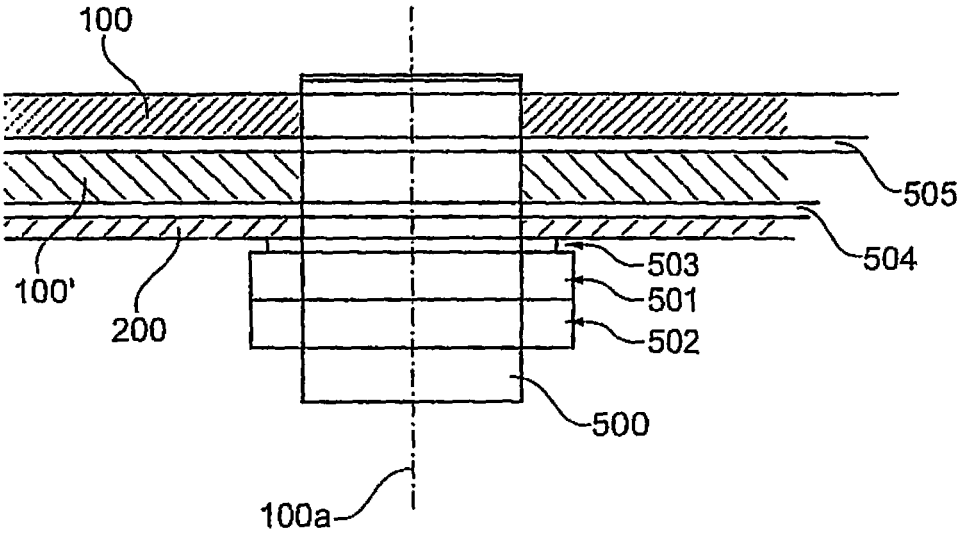

Exemplary embodiments of the invention are explained with reference to the drawings below, in which:

FIG. 1 shows a preferred first embodiment in a lateral view in an initial position, FIG. 2 shows the first embodiment according to FIG. 1 in a lateral view in the initial position without support of the second stop, FIG. 3 shows an intermediate position in the representation of FIG. 2, after performing a stroke, FIG. 4 shows the end position after performing a stroke in the representation of FIGS. 2 and 3, FIG. 5 shows a lateral view of the first embodiment according to FIG. 1 with representation of the impact on the second stop, FIG. 6 shows the end position of FIG. 4, in the representation of FIG. 5, FIG. 7 shows a plan view of the base plate, wherein FIG. 7*a* shows the view of FIGS. 2 to 4, and FIG. 7*b* shows the view of FIG. 1 and of FIGS. 5 and 6, FIG. 8 shows a lateral view of the training apparatus displaceable on a carriage, wherein FIG. 8*a* represents a lifted position, and FIG. 8*b* represents a lowered position, FIG. 9 shows schematic representations of the support of the ball, FIG. 10 shows a schematic view of a second embodiment of the apparatus in the resting position, FIGS. 11-13 show intermediate positions of the apparatus in the view of FIG. 10 after carrying out a stroke, FIG. 14 shows a view of a third embodiment of the apparatus, FIGS. 15-16 show intermediate positions of the apparatus, FIG. 17 shows a schematic lateral view of the housing having a cover, FIG. 18 shows a plan view of the housing in the area of the support bar, and FIG. 19 schematically shows the connection of the base plate to a stationary structure.

In FIG. 1, 1 designates a ball which is supported in a rotatable manner at 2, preferably by a ball bearing at the end of a profiled rod 3, for example an aluminium tube with rectangular cross-section, bent in the direction of stroke and having a pivot axis vertical to the plane of the drawing. The profiled rod 3 is formed stiff and its opposite end is pivotably supported at 4 at the upper end portion of a support bar 5, which for example consists of an aluminium tube having a rectangular cross-section.

The bend of the profiled rod 3 is designed such that, when carrying out a slice stroke, after impinging on the ball, the racket can follow through in a free manner and is not hindered by the pivoted profiled rod 3 (FIGS. 3 and 4).

FIG. 9 schematically shows the support of a ball 1 embodied of two half shells 1*a* and 1*b*, whose outer surface is preferably designed in two colours, so that after a topspin or slice stroke, the rotational movement of the ball is clearly recognisable.

The two half shells 1*a* and 1*b* of the ball are preferably manufactured from foamed material, for example polyurethane foam, wherein each half shell is held between a holding disc 1.1 and a flange 1.2 on a shaft 1.3, as FIG. 9*a* shows. The shaft 1.3 is formed in two parts, wherein a portion having a reduced diameter engages a sleeve-shaped part 1.31, as can be seen from FIGS. 9*a* and 9*b*. The two holding discs 1.1 are fixed by means of screws to the shaft, and the two half shells, which are fixedly connected to each other, are supported by means of a ball bearing 2 which is arranged on the portion of the shaft 1.3 which has a reduced diameter.

The pivotable support 4 of the profiled rod 3 can be formed at a sleeve 4.1 (FIG. 10) which is displaceable along the support bar 5, wherein the sleeve 4.1 is fixedly connectable to the support bar 5 in each position.

In the area of the articulation joint 4 of the profiled rod 3 at the support bar 5, advantageously, stops are provided, between which the profiled rod 3 is pivotable relative to the support bar 5, wherein the stops are advantageously provided with an elastomeric coating or with a damping pad.

FIG. 1 shows an upper damper 4*a* having an elastomeric pad which is fixedly connected to the support bar 5. Furthermore, a lower damper 4*b* is fixedly connected to the support bar 5; the profiled rod 3 lies on the lower damper in the resting position represented in FIG. 1.

Also, a spring impingement can be provided, which counteracts a pivot movement of the profiled rod 3 out of the position of FIG. 1 into the position of FIG. 4 and which biases the profiled rod 3 out of the pivoted position in FIG. 4 back into the initial position of FIG. 1.

In particular, at the bearing 4, a spring leaf can be provided which acts on the pivot movement of the profiled rod 3, so as to guarantee an elastic impingement of the racket on the ball 1.

FIGS. 2 to 4 show the basic structure of the hinged articulation of the support bar 5 at a base plate 100, wherein FIG. 2 corresponds to the initial position in FIG. 1.

The support bar 5 is pivotably supported at the lower end at 7 in or at a bearing block 6. The bearing block 6 can consist of two aluminium plates having an L-shaped cross-section, wherein the shorter legs are fixed at the base plate 100. The pivot movement of the support bar 5 against the direction of stroke is limited by a first stop 8. The support bar 5 abuts in the initial position of FIGS. 1 and 2 with its lower end at the first stop 8 which, in the embodiment of FIGS. 1 to 4, is formed as a gas pressure spring.

Instead of a gas pressure spring 8, a different stop can also be provided, preferably with a damping effect, as represented in the further embodiments which are described below.

After a stroke with the tennis racket on the ball 1 in FIG. 3, the support bar 5 impinges, by means of its pivot movement in clockwise direction around the articulated joint 7, on a second stop 9, which is pivotably supported in the first embodiment at the bearing block 6 at 9.2. The second stop 9 is formed by a stay 9.1 having an elastomeric pad 9.3 at the free end, on which the support bar 5 impinges on its pivot movement.

The second stop 9 is yieldingly supported by means of an opposing force, which is explained below by means of FIGS. 5 and 6.

After the support bar 5 abuts at the second stop 9 in the intermediate position of FIG. 3, then, on the further pivot movement of the support bar 5 in clockwise direction, the yieldable support of the second stop 9 comes into effect.

FIG. 4 shows the end position of the pivot movement of the support bar 5 after carrying out a stroke on the ball 1, wherein the second stop 9 abuts at a third stop 10, which is fixedly arranged on the base plate 100 and is provided with a damping pad 10*a*. In this end position of FIG. 4, the support bar 5 is elastically damped in two regards, by the damper pad 9.3 and the damper pad 10*a* at the third stop 10.

The free oscillation of the ball 1 out of the initial position in FIGS. 1 and 2 until impingement of the support bar 5 at the second stop 9, forms a kind of a running idle, because the force of the stroke on the ball 1 essentially only has to overcome the ball's own weight. In this way, this running idle until the impingement on the second stop 9 facilitates low resistance at the ball 1 during the impingement of the racket.

FIG. 3 shows the abutting of the support bar 5 at the second stop 9, after a stroke on the ball 1 has been carried out. On a first portion, the support bar 5 moves essentially in a free manner between the two stops 8 and 9. Only when the support bar 5 abuts at the second stop 9, after no contact exists any more between ball 1 and tennis racket, is the support bar 5 further pivoted against the effect of force by the impact of the performed stroke. In FIG. 2, the second stop 9 is still in the initial position of FIG. 1.

The second stop 9 can be supported by means of a rod assembly or a guide mechanism which acts on a counterweight 11 and transmits the pivot movement of the second stop 9 to this counterweight 11, for example by leverage action, as FIGS. 10 and 14 show.

Preferably, the damping stop 9 is acted on by means of a rotatably supported counterweight 11, which in FIG. 1 is mounted on a disc 12, which is connected by means of a rope 13, preferably a plastic-coated wire rope, to the free end of the damping stop 9, in order to move the stop 9 out of the end position in FIGS. 4 and 6, back into the position in FIGS. 2 and 5.

A disc 12, preferably made of aluminium, is rotatably supported on both sides of the bearing block 6; the counterweight 11 is mounted on the circumference of the two discs 12. The rope 13 is guided from the circumference of the two discs 12 to the upper end of the damping stop 9, so that during pivoting of the damping stop 9 by means of the support bar 5 the discs 12 are rotated in clockwise direction in FIGS. 5 and 6. Here, the counterweight 11 functions to damp the pivot movement of the support bar 5 as soon as the damping stop 9 is pivoted by the support bar 5.

For a gentle damping of the damping stop 9, the rope 13 is guided on the two discs 12 along a curve, especially along a recess 12*a* formed in a spiral shape, through which the rotational movement of the disc 12 having the counterweight 11 starts only slowly during the initial movement of the damping stop 9 and then becomes more and more powerful, the farther the damping stop 9 is pivoted in clockwise direction.

The support bar device moves itself out of the end position in FIGS. 4 and 6 back into the initial position of FIGS. 1, 2 and 5, by the counterweight 11, which is mounted on the discs 12, rotating the discs 12 back in anti-clockwise direction and thus pivoting the damping stop 9 in anti-clockwise direction by means of the rope 13 which entrains the support bar 5. As soon as the support bar 5 is in a position corresponding to FIG. 3, in which the damping stop 9 is no longer pivoted in anti-clockwise direction, the weight of the profiled rod 3 protruding from the support bar 5 acts on the support bar 5 such that the support bar 5 moves further in anti-clockwise direction back into the initial position of FIGS. 5 and 2, wherein the lower end of the support bar 5 comes to abut at the preferably damped stop 8, especially in the form of the gas pressure spring, and is decelerated.

In the case of this embodiment, the gas pressure spring 8 provides for the ball 1 to be returned at an even speed, and for the ball 1 to rest again in the initial position of FIG. 1.

Preferably, a stop 11*a* is provided for the counterweight 11 in the end position, which stop is represented in FIG. 1 on the base plate 100.

FIG. 7*a* shows a plan view of the base plate 100 having the bearing block 6, wherein, for clearer representation, the discs 12 having the counterweight 11 are omitted. FIG. 7*b* shows a plan view of the base plate 100 corresponding to FIGS. 1 and 5, having counterweight 11 and discs 12.

As FIG. 7*a* shows, the bearing block 6 is embodied by two L-profiles 6.1 and 6.2 arranged parallel to one another, preferably of aluminium, between which the support bar 5 is pivotable on a bearing pin 7.

The bearing block 6 is fixed on the base plate 100, which is pivotable around a bearing indicated in FIG. 1 at 100*a* in the plane of the drawing of FIG. 7*a*, to the right and left relative to a stationary structure 200 which, in the embodiment shown, is the housing 200 on a carriage explained below. In FIG. 7*a*, the pivot axis 100*a* of the base plate 100, which pivot axis is vertical to the plane of the drawing, is in the area of the support bar 5, as can be seen from FIG. 1. At the front side of the base plate 100, a projection 100.1 made of ferromagnetic material is provided, which is in the resting position between two magnets 102 at a distance from these. The two magnets 102 are arranged on a plate 100', on which the base plate 100 is arranged in a laterally movable and pivotable manner in a determined range, so that the base plate 100 can horizontally oscillate and vibrate in a determined range relative to the plate 100', when the ball 1 is struck at the profiled rod 3 somewhat laterally to the plane of pivoting of the support bar 5 and thus a lateral force is introduced into the bearing block 6. After a lateral movement of the base plate 100 relative to the plate 100', the base plate 100 is pushed by the magnets 102 back into the middle position shown in FIG. 7*a*.

A handwheel 300 is rotatable at the stationary structure 200; around the handwheel, a toothed belt 301 is guided, which is guided over deflection rollers 302 and fixed at the ends at the upper end of the plate 100' at 303 in FIG. 7*a*. By rotating the handwheel 300, an inclined position of the plate 100' and thus of the base plate 100 can be set. At 304, a detent is provided on the circumference of the handwheel 300, so that the handwheel 300 can be fixed in a predetermined pivot position.

By means of a double arrow P in FIG. 7*a*, it is indicated that the plate 100' having the base plate 100 can be pivoted in both directions relative to the stationary construction 200.

FIG. 7*b* shows the same view as FIG. 7*a*, wherein, however, the discs 12 are represented having counterweight 11. The counterweight 11 of this embodiment connects the two discs 12, so that they form a unit, which is connected by means of the wire rope 13 to the second stop 9, which is not represented in FIG. 7*b*.

FIG. 8 shows a lateral view of an apparatus in which the training apparatus is fixed on a height-displaceable carriage.

The training apparatus having the base plate 100 is mounted on the bottom plate 200 of a box-shaped housing 200*a*, which is joined in an articulated manner by means of two guide mechanisms 201*a* and 201*b* to a carriage 202, at which lockable wheels 202.1 and a handle for displacement on a rod 202.2, are mounted. Reference sign 204 designates a rod between the guide mechanism 201*a* and the carriage 202, by means of which the height-positioning of the housing 200*a* can be fixed in each position at 204*a* relative to the carriage 202.

FIG. 8*b* shows a lowered position of the training apparatus and FIG. 8*a* shows a lifted position.

The described training apparatus can be provided with electric sensors and a software program by means of which details and parameters of a stroke on the bail 1 can be registered and displayed, for example on a monitor having a printer, and printed out.

The hinging of the base plate 100 on the plate 100' and the vibration movement of the base plate 100 between the magnets 102 serves for the detection of the individual parameters of a stroke by the tennis racket on the ball 1.

A scanner or sampler can also be provided, by means of which the number of the strokes can be registered, which is then supplied to the electronics assembly and processed.

In the carriage 202, for example an accumulator can be provided for the electric power supply of the electronic component parts, and an electric motor can be provided for the driving of the height displacement of the carriage.

FIG. 10 shows a schematic lateral view of a second embodiment, in which the second stop 9 is supported by means of a guide assembly 17 through a counterweight 11 displaceable on a roller 15.

For the sake of simplified representation, stops which delimit the pivot movement of the profiled rod 3 at the place of linking of the profiled rod 3 at the support bar 5, are omitted.

Same or corresponding component parts are provided with the same reference signs as in FIGS. 1 to 9.

FIGS. 11 to 13 correspond to FIGS. 3 and 4 of the first embodiment with regard to the relative position of the individual parts of the apparatus.

In this embodiment, the stops 8 and 9 are formed as rollers, which can be made of an elastomeric material, wherein the second stop 9 acts via a guide mechanism 17, 17*a* against a counterweight 11 which rests on the roller 15. The guide mechanism has a lever 17, formed in the manner of an acute angle, one end of which is linked at 17.1 to the bearing block 6 and to the base and the opposite end of which at 17.2 is connected in an articulated manner to an end of the longitudinal counterweight 11. The bent portion 17.3 of the lever 17 serves as a support on the base B in the resting position.

This embodiment can also be positioned in a height-displaceable manner on a carriage 200, 202.

FIG. 14 schematically shows a third embodiment.

At 20, a bearing fixed on the base B is designated, at the free end of which a double-arm lever 21 is swivelably supported approximately in the middle at 21.1 (FIG. 15).

The left end of the double-arm lever 21 is joined in an articulated manner at 21.2 to a guide mechanism 24, which is hingedly attached at the second stop 9 at 24.1. The opposite end of the double-arm lever 12 is attached in an articulated manner at 21.3 to a counterweight 11, preferably formed rod-shaped, for example a metal cylinder, which lies on a roller 15, preferably a rubber roller, which is rotatably fixed by means of a bearing at 15.1 on the base B.

In the initial position of FIG. 14, the double-arm lever 21 lies somewhat inclined relative to the longitudinal axis of the counterweight 11 and to the longitudinal axis of the guide mechanism 14, so that after further pivoting movement of the support bar 5 in clockwise direction in FIG. 15 the left end of the double-arm lever 21 is displaced downward by the guide mechanism 14 and the right end of the lever 21 is swiveled upward, wherein this end of the lever 21 draws the counterweight 11 upward during unwinding on the roller 15.

FIG. 16 shows a possible end position of the ball 1 after a forceful stroke, wherein the lever 21 is swiveled in anti-clockwise direction and the counterweight 11 is lifted relatively far, so that the lower end portion of the rod-shaped counterweight 11 lies on the roller 15.

The evasive movement of the profiled rod 3 in connection with the bent shape, as represented in FIG. 16, serves above all to allow a free space for the follow-through of the racket after carrying out a slice stroke.

From the end position in FIG. 16, the support bar device moves itself back into the initial position of FIG. 14, wherein the counterweight 11, lying on the roller 15, by the effect of gravity of the portion protruding over the roller 15 which draws the counterweight 11 downwards, swivels the double-arm lever 21 in clockwise direction, while the counterweight 11 unwinds in a rightward direction on the roller 15, so that the left end of the lever 21 via the guide mechanism 14 displaces the second stop 9 and, with it, the support bar 5, back into the position of FIG. 15. After reaching the position in FIG. 15, the support bar 5 is released by the weight of the profiled rod 3 and of the ball 1 from the second stop 9 and tips back into the position of FIG. 14, in which it abuts at the first stop 8, preferably with a slight incline to the left.

During this pivot movement of the support bar 5 in anticlockwise direction out of the end position in FIG. 16 into the initial position in FIG. 14, the profiled rod 3 at the bearing 4 is also moved, due to its weight, out of the extended position relative to the support bar 5 in FIG. 16, back into the position of FIG. 14, in which the profiled rod 3 lies approximately at an angle of 100 to 120° in relation to the support bar 5.

FIG. 14 shows on the base B a counter-bearing 16 for the counterweight 11, which abuts in the initial position, by means of its front end, at a damper 16.1, wherein the counterweight 11 is held by the roller 15 in an inclined position relative to the lever 21.

Instead of a damper 8.1 in FIG. 15, a hydraulic damper 8*a* (FIG. 14) can also be mounted at the bearing block 6, which forms the first stop and returns the support bar 5 with the ball 1 into the initial position without rebounding, when the support bar 5 swings back after impingement of the second movable stop 9.

FIG. 17 schematically shows a lateral view of the training apparatus of the first embodiment having a housing corresponding to FIG. 8, wherein a covering hood 200*b* is provided above the base plate 100; the covering hood protects the construction on the base plate 100 from dust and dirt, because especially in the initial phase of a stroke on the ball 1, the pivot of the support bar 5 should take place as free from friction and from resistance as possible.

The handwheel 300 is arranged on the closed hood 200*b*, as shown in the plan view in FIG. 18, by means of which the base plate 100 with the support bar 5 can be swiveled. FIG. 18 shows a swivel to the left and a swivel to the right relative to the housing 200.

As the support bar 5 is pivotable in the stroke direction of the ball 1 and is swiveled laterally relative to the housing, as FIG. 18 shows, a plastic plate 400 is movably mounted on the hood 200*b*, which plastic plate has a metal frame 401 having a middle longitudinal slot 402 along which the support bar 5 is movable.

To protect the slot 402 from the penetration of dust and dirt, a brush cover 403 is provided, preferably made of glass fibre, by means of which the movement of the support bar 5 along the slot 402 is hindered as little as possible. The glass fibres extend from ridges provided on both sides of the slot 402 approximately to the middle of the slot, so that the support bar 5 can move without significant resistance along the slot 402.

FIG. 19 schematically shows the hinged link of the apparatus on the bottom plate 200 of the housing in FIG. 8 having the swivel axis indicated in FIG. 1 at 100*a*.

A hinge pin 500 is rotatably inserted in a bore of the bottom plate 200; a nut 501 and a counter nut 502 are screwed on the hinge pin. A Teflon disc 503 is provided between nut 501 and bottom plate 200, by means of which the friction between bottom plate 200 and nut 501 is maintained low.

The hinge pin 500 is pressed-fitted, in a manner so as to be fixed against rotation, in a bore of the plate 100' which is swivelable around the axis of the hinge pin 500 relative to the bottom plate 200, by means of the handwheel 300 and the toothed belt 301.

A plastic plate 504 is inserted between bottom plate 200 and plate 100' for reducing friction.

Above the plate 100', the base plate 100 of the apparatus is mounted in a swivelable manner on the hinge pin 500, so that the base plate 100 is swivelable relative to the plate 100' between the magnets 102 on the plate 100'. A further plastic plate 505 is provided between the bottom plate 100 and the plate 100' for reducing friction.

By rotating the handwheel 300, the plate 100' can be swiveled relative to the bottom plate 200 of the housing, wherein the base plate 100, on which the bearing block 6 is fixed, is entrained into the swivel position by means of its projection 100.1 between the magnets 102 fixed on the plate 100'.

The described practice apparatus can be used as a home gym device in the cellar or in a garage, but also as an aid for a tennis teacher. The apparatus can especially be used for practising topspin, lob and slice strokes. The rotation of the ball is represented optically for topspin and slice strokes by means of the colour change at the ball. Also, an electronic rotational speed measurement at the ball is possible, wherein the rotational speed of the ball can be displayed on a display (not shown).

As the ball 1 is positioned again and again in the initial position at the same position, the racket swing can be automatized.

Various embodiments of the described construction are possible. For example, instead of the counterweight 11, a spring structure can be provided, which elastically damps the second stop 9 by means of the guide mechanism 10 and 10*a*.

The invention claimed is:

1. Tennis training apparatus, comprising a support bar (5) joined in an articulated manner to a base (B, 6), which support bar is pivotable between a first (8) and a second stop (9) and supports in a pivotable manner a profiled rod (3) protruding from the support bar (5), at the free end of the profiled rod (3) a ball (1) is rotatably supported, wherein the second stop (9), in direction of stroke, is pivotably supported against a force, wherein a rod (3) is joined pivotably at the support bar (5) in an articulated manner between yieldably damping stops.

2. Apparatus according to claim 1, wherein the second stop (9) in stroke direction is pivotably supported by a displaceable counterweight (11), which is movable, swivelable, by means of a pivot movement of the second stop (9).

3. Apparatus according to claim 1, wherein the profiled rod (3) is joined pivotably at the support bar (5) in an articulated manner between yieldably damping stops.

4. Apparatus according to claim 3, wherein the pivotable bearing of the profiled rod (3) is displaceable along the support bar (5).

5. Apparatus according to claim 3, wherein the profiled rod (3) is bent.

6. Apparatus according to claim 3, wherein the profiled rod (3) is formed longer than, the support bar (5).

7. Apparatus according to claim 1, wherein wherein the second stop (9) in stroke direction is pivotably supported by a displaceable counterweight (11), which is movable, swivelable, by means of a pivot movement of the second stop (9), wherein the return movement of the rotatable counterweight (11) is limited by a stop (11*a*).

8. Tennis training apparatus, comprising a support bar (5) joined in an articulated manner to a base (B, 6), which support bar is pivotable between a first (8) and a second stop (9) and supports in a pivotable manner a profiled rod (3) protruding from the support bar (5), at the free end of the profiled rod (3) a ball (1) is rotatably supported, wherein the second stop (9), in direction of stroke, is pivotably supported against a force, wherein a rod (3) is joined pivotably at the support bar (5) in an articulated manner between yieldably damping stops, wherein the second stop (9) is supported by a rotatable counterweight (11), which is mounted on the circumference of a disc (12), which is connected to the stop (9) by means of a rope (13).

9. Apparatus according to claim 8, wherein the profiled rod (3) is pivotably mounted in direction of stroke between two plates (6.1, 6.2) forming a bearing block (6).

10. Apparatus according to claim 9, wherein the bearing block (6) is mounted on a base plate (100), which is swivelable by means of a displacement means (300) relative to a stationary structure (200) around a vertical pivot axis (100*a*) and fixable in the swivel position.

11. Tennis training apparatus, comprising a support bar (5) joined in an articulated manner to a base (B, 6), which support bar is pivotable between a first (8) and a second stop (9) and supports in a pivotable manner a profiled rod (3) protruding from the support bar (5), at the free end of the profiled rod (3)a ball (1) is rotatably supported, wherein the second stop (9), in direction of stroke, is pivotably supported against a force, wherein wherein the bearing block (6) is mounted on a base plate (100), which is swivelable by means of a displacement means (300) relative to a stationary structure (200) around a vertical pivot axis (100*a*) and fixable in the swivel position, wherein profiled rod (3) is pivotably mounted in direction of stroke between two plates (6.1, 6.2) forming a bearing block (6).

wherein the base plate (100) is mounted on a swivelable plate (100') swivelably in a small angle range, on which magnets (102) are mounted at a distance from each other, between which the bearing block (6) can oscillate.

12. Apparatus according to claim 11 wherein the apparatus is arranged in a housing (200) which can be displaced heightwise by means of a rod assembly on a carriage.

13. Apparatus according to claim 11, wherein sensors and an electronic storage means are provided, by means of which parameters of the ball movement are recorded and stored.

14. Apparatus according to claim 11, wherein the pivot movement of the second stop (9) in stroke direction is limited by means of a stop (10).

15. Apparatus according to claim 11, wherein the first stop (8) is formed by a gas spring.

* * * * *